United States Patent [19]

Norman et al.

[11] Patent Number: 4,858,628

[45] Date of Patent: Aug. 22, 1989

[54] SMOKING MACHINE

[75] Inventors: Alan B. Norman, Clemmons; David W. Griffith, Jr., Winston-Salem; Dewey L. Holt, Winston-Salem; John H. Reynolds, IV, Winston-Salem; Stephen B. Sears, Winston-Salem, all of N.C.

[73] Assignee: R. J. Reynolds Tobacco Company, Winston-Salem, N.C.

[21] Appl. No.: 121,304

[22] Filed: Nov. 16, 1987

[51] Int. Cl.[4] ..... A24C 5/60

[52] U.S. Cl. ..... 131/329; 73/38; 73/865.6

[58] Field of Search ..... 131/329; 73/38, 865.6

[56] References Cited

U.S. PATENT DOCUMENTS 3,433,054 3/1969 Mutter .
3,460,374 8/1969 Parks .
4,019,366 4/1977 Claflin et al. .
4,204,550 4/1980 Newman et al. .
4,365,640 12/1982 Lorenz et al. .
4,488,562 12/1984 Remington .
4,596,257 6/1986 Garthaffner et al. .
4,627,448 12/1986 Kamm et al. .

FOREIGN PATENT DOCUMENTS 3236593 9/1984 Fed. Rep. of Germany .
2181844 4/1987 United Kingdom .

OTHER PUBLICATIONS

Smoking Behavior, Raymond E. Thornton, Churchill Livingstone Publishers, 1978, pp. 277-288.

*Primary Examiner*—V. Millin
*Attorney, Agent, or Firm*—Stephen M. Bodenheimer, Jr.

[57] ABSTRACT

A method and apparatus for automated smoking to replicate a predetermined draw profile of a smoking article is disclosed. In preferred embodiments, the smoking apparatus is digitally controlled and includes simulated flexible lips which are closed during puff phases of a recorded draw profile and which are open during smolder phases of a recorded draw profile. The apparatus can also include an automatically acting lighter and an improved control system for a human mimic smoking machine.

16 Claims, 9 Drawing Sheets

SMOKING MACHINE

FIELD OF THE INVENTION

The invention relates to an automated smoking method and apparatus, i.e., smoking article testing machine. More specifically, the invention relates to a smoking machine capable of accurately reproducing a predetermined draw profile of a smoking article, including non-repetitive and complex draw profiles such as human draw profiles of a cigarette.

BACKGROUND OF THE INVENTION

Smoking machines are used in connection with the tobacco industry to determine FTC tar and nicotine values of various cigarettes when smoked according to certain standard test conditions. The smoking machine provides for the collection of various substances contained in cigarette smoke. The substances are later fed to an analysis stage.

It is sometimes desirable to determine the performance of various cigarettes when smoked according to non-standard conditions. In this regard, many commercially available smoking machines are meant to measure smoking for specific draw profiles and adjustment is difficult. Moreover, motor-driven multiport machines are often incapable of reproducing some extreme profiles due to the inability of large motors to change speeds rapidly enough. In the extreme case, it is sometimes desirable to replicate accurately the recorded draw profile of a human test subject. Actual human puff profiles represented by a recorded pressure differential as a function of time can be measured as a test subject smokes a cigarette. Essentially, the cigarette is smoked through a tube having a constriction at its intermediate point. The differential between the upstream and downstream pressure can be measured via transducers and this pressure differential recorded digitally as a function of time to provide a puff profile including puff phases wherein the cigarette is being inhaled, and pause or smolder phases wherein the cigarette is not being inhaled.

Equipment for receiving the recorded puff profiles and simulating or mimicking the recorded human smoking behavior on a smoking machine has been described in SMOKING BEHAVIOR by Raymond E. Thornton, Churchill Livington Publishers, 1978, pp. 277–288. The puff profile is converted into an analog signal, which in turn, controls an analog valve between a vacuum chamber and a cigarette, the valves opening or closing more or less depending on the particular values of the recorded draw profile.

U.S. Pat. No. 4,365,640 describes a smoking machine capable of simulating human smoking, based on a recorded draw profile by a different control scheme. A step motor controls the operation of a vacuum cylinder. The stepping motor is controlled by a control circuit which converts an analog signal corresponding to a human draw profile into control signals for the stepping motor. Valves located between the cigarette and vacuum cylinder are also controlled by the control circuit to allow smoke collected in the vacuum cylinder to be exhaled during the smolder phases of the draw profile. A valved bypass is located between the cigarettes and Cambridge filter pads which collect FTC tar and nicotine. During the puffing phase, these valves are closed so that smoke from the cigarettes passes through the filter pads and into the vacuum chamber. During the smolder phase, these valves are opened to communication with the atmosphere to simulate a condition in which the smoker takes the cigarette out of the mouth. The control circuit includes provision for a delay between the inhale cycle and the exhale cycle in order to allow more accurate reproduction of "double draw" puffs. D.E. No. 3236593 discloses a smoking machine having a movable element between the smoking article and the vacuum source. The magnitude of inhalation cycle can be controlled by positioning of the movable element or valve.

The known programmable smoking machines such as those described above are dependent on motor speed changes for reproduction of a puff profile. Inertial, mechanical, electrical and magnetic resistance to speed changes result in inherent difficulties in accurately duplicating puff profiles, particularly with respect to rapidly changing portions thereof. In addition, known control systems for such smoking machines suffer various drawbacks, including ease of modification, accuracy of control and the like. Further, methods used by such machines to duplicate recorded draw profiles do not always accurately reproduce the physical smoking conditions of the recorded draw profile. In addition, use of some motor-driven systems involves inherent capacity or accuracy limitations in that the number of ports, i.e., the number of cigarettes which can be smoked simultaneously, must be limited or accuracy must be sacrificed.

SUMMARY OF THE INVENTION

The invention provides improved apparatus, control systems and methods for machine reproduction of predetermined draw profiles, including mimic of experimentally recorded draw profiles.

In one aspect, the invention provides a smoking machine having a suction means for drawing smoke through a smoking article together with a control means for the suction means in which the control means includes: (i) storage for storing data representative of a predetermined draw profile of a smoking article which includes puff and smolder phases; and (ii) means for producing digital control signals for controlling the operation of the suction means to digitally mimic the predetermined draw profile. Advantageously, the suction means are piston and cylinder means and the apparatus includes means responsive to the digital control signals for positioning the piston at a predetermined location in the cylinder as dictated by each of the digital control signals.

In another aspect, the invention provides a hydraulically actuated automated smoking machine, advantageously a multiport smoking machine. A hydraulic ram controls the piston movement of one or more ports on the single or multiport apparatus, respectively. Control means provide movement of the hydraulic ram according to a predetermined pattern. Modification of the system operation is easily effected, i.e., without cumbersome mechanical adjustment, simply by changing control signals which control the hydraulic ram. The hydraulic ram can readily supply sufficient power to actuate many smoking port piston and cylinder means. Additionally, movement of the hydraulic ram can readily be varied with minimal magnetic and electrical resistance.

In addition, the invention provides a smoking machine for smoking a smoking article according to a predetermined draw profile, including puff and smolder phases, which includes control means, suction means responsive to the control means, and support means coupled to the suction means for supporting the smokable object. The support means includes simulated flexible lip means having closed and open configurations. In the closed configuration, the simulated lips grasp the smoking article's mouth end periphery in an airtight relationship. In the open configuration, the lips surround the smoking article's mouthend periphery in a non-airtight relationship. The lips are responsive to the control means for operation in the closed configuration during the puff phases of the predetermined draw profile and for operation in the open configuration during smolder phase of the recorded draw profile.

Control embodiments of the invention are directed to a method and system for operating a smoking machine. The control system includes storage for storing data representative of a measured draw profile of a smoking article including puff and smolder phases. Suction signals are generated as a function of the puff phases of the draw profile. Wait signals are generated corresponding to a portion of the smolder phases. The system determines whether the length of a smolder phase is greater than a predetermined value and generates exhale, i.e., exhaust signals when smolder phase length exceeds the predetermined value. Open- and closed-to atmosphere signals, e.g., open lips and closed lips signals, are generated for the smolder and puff phases, respectively. Wait signals are generated for maintaining the smoking article in the closed to atmosphere configuration during a discrete time period after the end of each puff phase to allow for puff decay, that is, time for the moving smoke to reach substantial equilibrium or quiescence.

In preferred embodiments of the invention wherein the inhaling means is a vacuum cylinder, i.e., piston and cylinder, controlled by a hydraulically operated ram, it has been found that the hydraulic system can readily and accurately reproduce rapid changes in puff profile. Other preferred aspects of the invention include automatically acting lighters for lighting cigarettes during operation of the smoking machine. The control system provides engagement of the automatic lighter with the smoking article during a plurality of lighting puffs according to information recorded in or derived from a measured draw profile. The control system can also provide abort signals causing termination of the smoking machine's operation when the system determines that the value of an inhale signal is greater than a predetermined value. For example, in a preferred embodiment an abort signal is generated when an inhale signal, representing a location for the piston in the vacuum cylinder, represents a location beyond the stroke of the piston within the vacuum cylinder. Preferably, the control of the smoking machine is carried out by a programmed computer.

BRIEF DESCRIPTION OF THE DRAWINGS

In the drawings which form a part of the original disclosure.

DESCRIPTION OF THE PREFERRED EMBODIMENT

Apparatus

Figure 1:
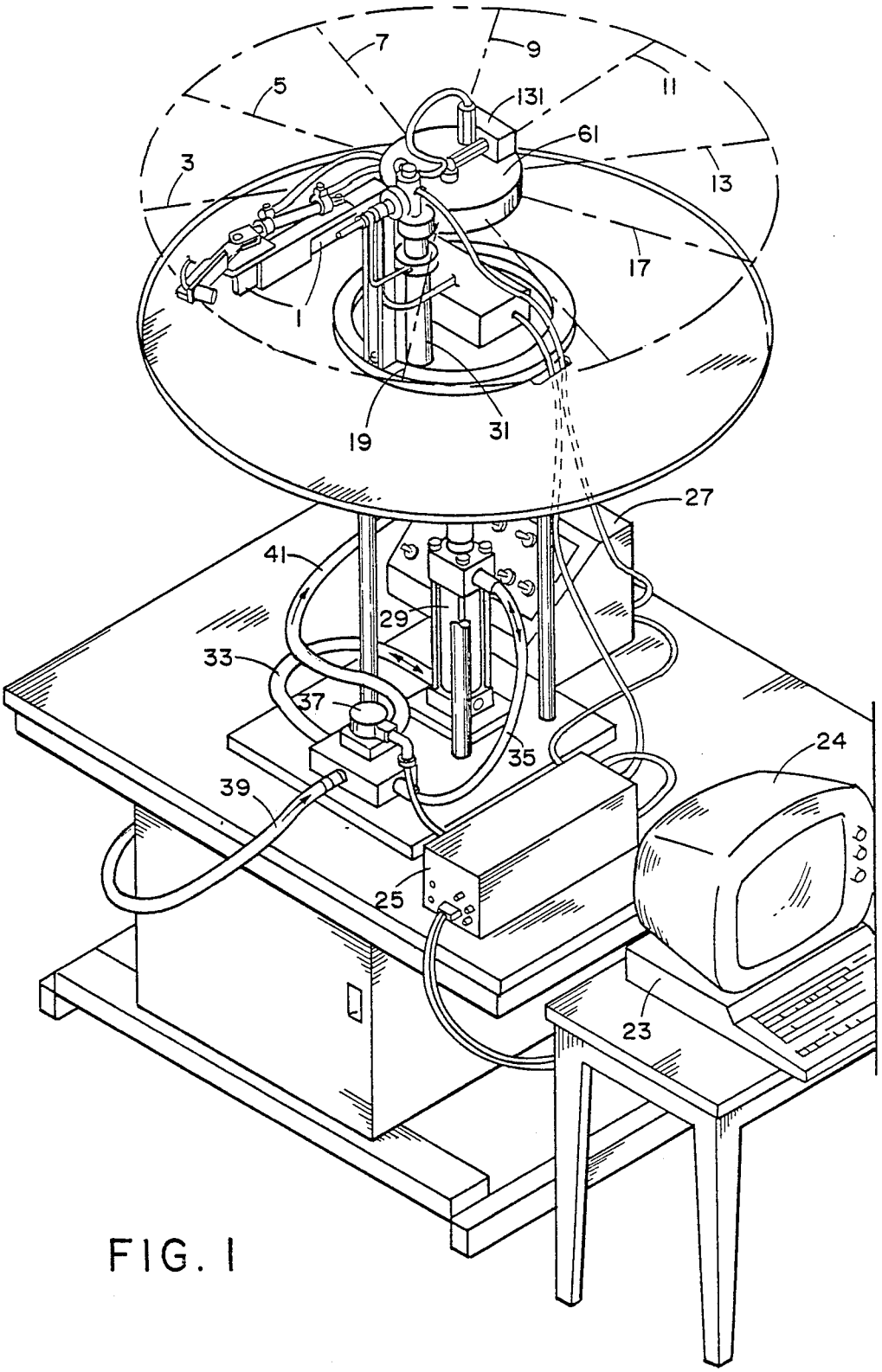
FIG. 1 is a top perspective view of a preferred human mimic smoking machine of the invention and illustrates one of ten smoking positions.
Figure 3:
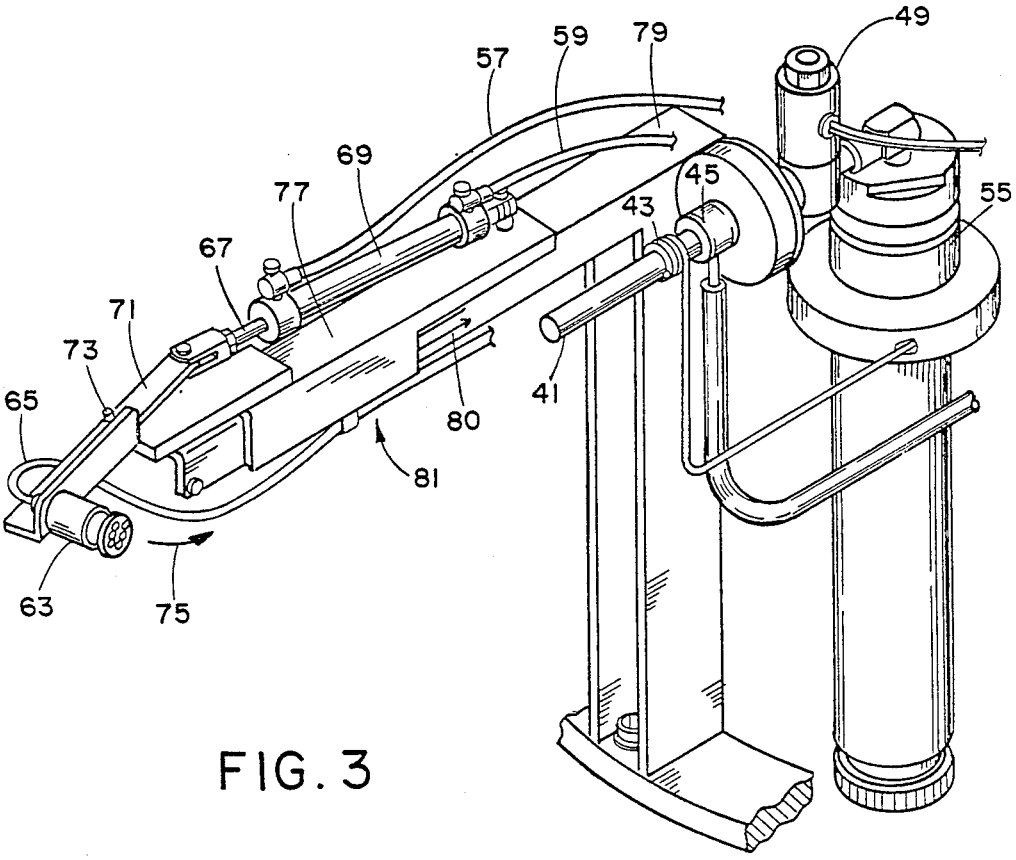
FIG. 3 illustrates the automatic lighting feature of the invention and relationship thereof with the smoking article to be tested.

FIG. 1 is a top perspective view of a preferred apparatus embodiment of the invention. A single smoking position 1 is illustrated for simplicity. However, nine other smoking positions indicated by radial lines 3–19 are preferably included in the apparatus. In general, the system comprises a plurality of cigarette smoking positions 1, which is also shown in FIG. 3. The system is preferably controlled by a programmed computer 23 which connects to input output interface 25, which in turn is connected to relay and counter 27. A hydraulically operated ram 29 drives a plurality of vacuum cylinders 31. Hydraulic ram 29 is connected via hydraulic fluid line 33 and hydraulic fluid line 35 to computer controlled valve 37. Valve 37 is connected to a pump means (not shown) via hydraulic input line 39 and output line 41.

Figure 2:
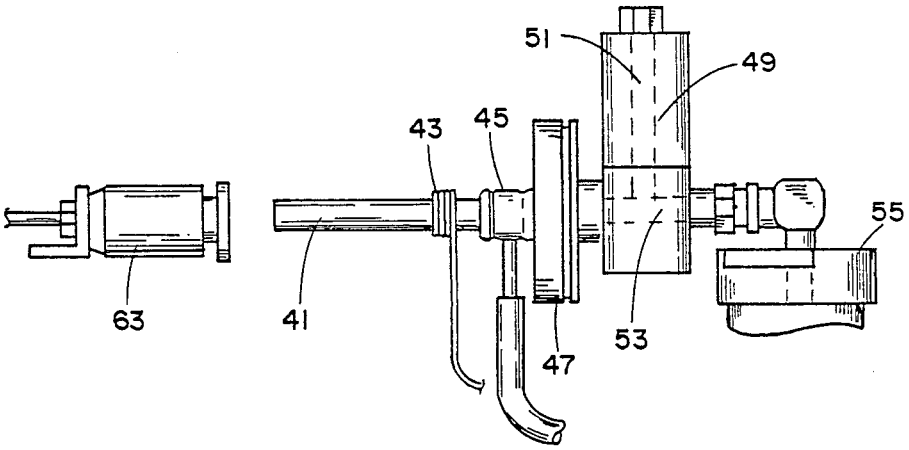
FIG. 2 is a side view of a portion of a preferred smoking article support means according to the invention illustrating the coupling thereof to a Cambridge filter pad holder, magnetic valve and vacuum cylinder.

With reference to FIG. 2, a smoking article, 41 is supported by support means 43 such that the mouthend of the smoking article is retained within flexible lip means 45. Cambridge filter pad holder 47 is located between the smoking article and electric solenoid three-way valve 49 which includes an exhaust port 51 and a communication channel 53 to vacuum cylinder 55, best shown in FIG. 3. With reference to FIG. 3, a pneumatically operated automatic lighter is connected via pneumatic supply and return lines 57 and 59, respectively to manifold 61 (FIG. 1). Lighter 63 connects via electrical cable 65 to interface 25 (FIG. 1). A pneumatic piston 67 and cylinder 69 cooperate to cause lighter arm 71 to pivot about point 73 in the direction indicated by arrow 75 from the retracted position shown in FIG. 3 to an engagement position wherein the lighter 63 is axially aligned with smoking article 41 as shown in FIG. 2. The automatic lighter is supported upon a support 77 which, in turn, is slidably mounted upon support 79. In the engagement position, i.e., when piston 67 is fully extended, support 77 can be moved in the direction indicated by arrow 80 manually or by automatic means so that lighter 63 engages the tip of smoking article 41. Support 77 includes a spring-loaded friction device generally at the location indicated by arrow 81 so that when moved, support 77 will remain at the new location. This "sets" the lighter position so that it will automatically light the smoking article when the lighter receives "engage" and "lighter on" signals from the system control.

Figure 4:
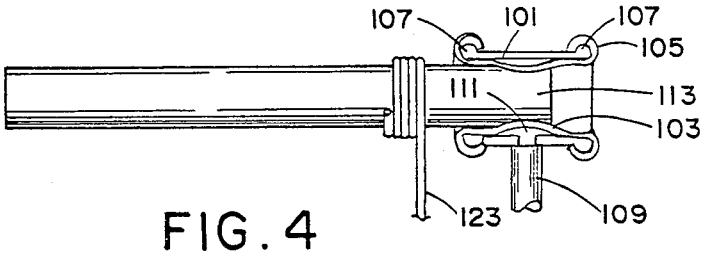
FIGS. 4 and 4A illustrate the smoking article support and simulated flexible lips in closed and open positions, respectively.
Figure 4A:
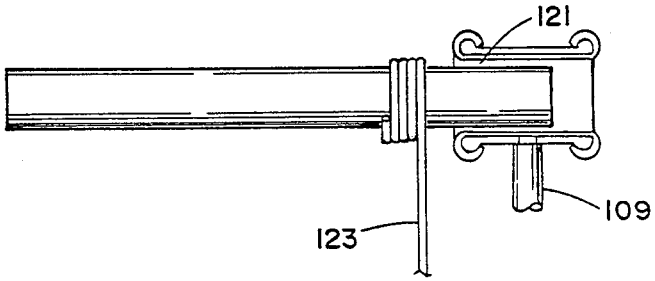

FIGS. 4 and 4A illustrate the flexible simulated lips and support means according to the present invention. A tubular support 101 is lined with a flexible plastic liner 103 such that the ends 105 of the liner are rolled back over the ends 107 of tube 101. A pneumatic supply line 109 communicates with the space 111 between the liner and the interior of the tubular support. At ambient air pressure, the flexible liner or lips 103 grasps the mouthend 113 of the smoking article in an airtight relationship. When vacuum is applied via line 109, the flexible liner clings to the sides of the tubular support so that the mouthend of smoking article can communicate via air channels 121 with the surrounding atmosphere. Support retaining means 123 maintains smoking article within the flexible simulated lips while the flexible lips are in the open position as shown in FIG. 4A. Tubular support 101 including air supply line 109 is commercially available from Cigarette Components Limited, Flexible liner 109 is normally constructed from Penrose Surgical Drain Tubing. As used in the past, such supports and liners are used in connection with automatic smoking machines to open the lips prior to smoking of the smoking article and the lips remained closed throughout the smoking thereof. It will be recognized that by making the tubular support 101 substantially larger, the lips can be caused to close, as shown in FIG. 4, via pressure supplied through line 109.

With reference again to FIG. 1, the operation of pneumatic supply for the automatic lighter is controlled by electric valve 131 so that air is supplied via manifold 61 according to control signals sent to valve 131. Similarly, a second manifold and electric valve control pneumatic supply to the flexible lips according to predetermined control signals.

Figure 5:
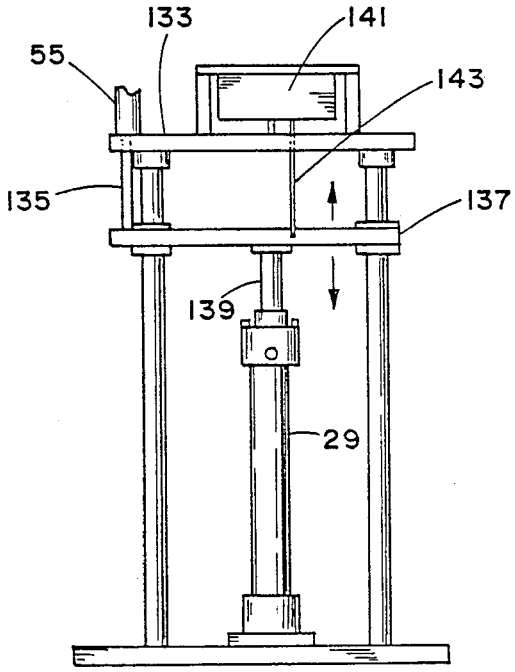
FIG. 5 is a side view of a portion of a preferred smoking machine according to the invention illustrating a portion of a hydraulic drive system and connection thereof to the vacuum cylinder.

FIG. 5 illustrates operation of the hydraulic system for operating vacuum cylinder 55. A plurality of vacuum cylinders 55 are connected to a fixedly mounted upper plate 133. The pistons of the vacuum cylinders 135 are connected to a slidably mounted lower plate 137 so that movement of the lower plate in turn moves the pistons within vacuum cylinders 55. The movement of the lower plate is controlled by hydraulic ram 29. Thus, when piston 139 of hydraulic ram 29 moves, lower plate 137, in turn, moves causing movement of piston 135 within vacuum cylinder 55. A potentiometer 141 is connected via wire 143 with lower plate 137 for calibration of the stroke limits of hydraulic ram 29.

SYSTEM OPERATION

In the preferred embodiment, the apparatus of the invention is operated via a control system which stores a complete set of digital commands for replication of a predetermined draw profile. Each command advantageously includes (i) a positional command for the hydraulic ram; (ii) a command for puff valve 49 defining either an exhaust (open) or suction (closed) state; (iii) a command for automatic lips defining either an open or closed state and; (iv) two commands for the automatic lighter, one for the on or off state and one for the contact or retracted state.

The commands thus define the state of the apparatus at periodic intervals of, e.g., 20–100 milliseconds. During the puff phase of a draw profile, the commands sent to the hydraulic ram define increasingly lower ram positions; the puff valve is closed; lips are closed and the lighter is off and retracted (unless the puff is a lighting puff). During smolder, the puff is normally exhausted. In this case, the ram is advantageously moved first to a position ½ the distance from a full upstroke and then to a position at full upstroke while the puff valve is open. This accomplishes rapid exhaust. In some instances, the control system determines that exhaust cannot be carried out in the allotted smolder time. In such case, the machine holds the puff during smolder and exhaust is simply skipped. During the next smolder, a double puff is then exhausted.

Details of the system operation are set forth below, in the context of a preferred embodiment for "human mimic" operation. Those skilled in the art will recognize that the invention is however applicable to less complex operations, as for example, a programmable system for a plurality of predetermined draw profiles or for a system wherein a given puff profile can be varied by operator instructions to the control system.

Figure 6:
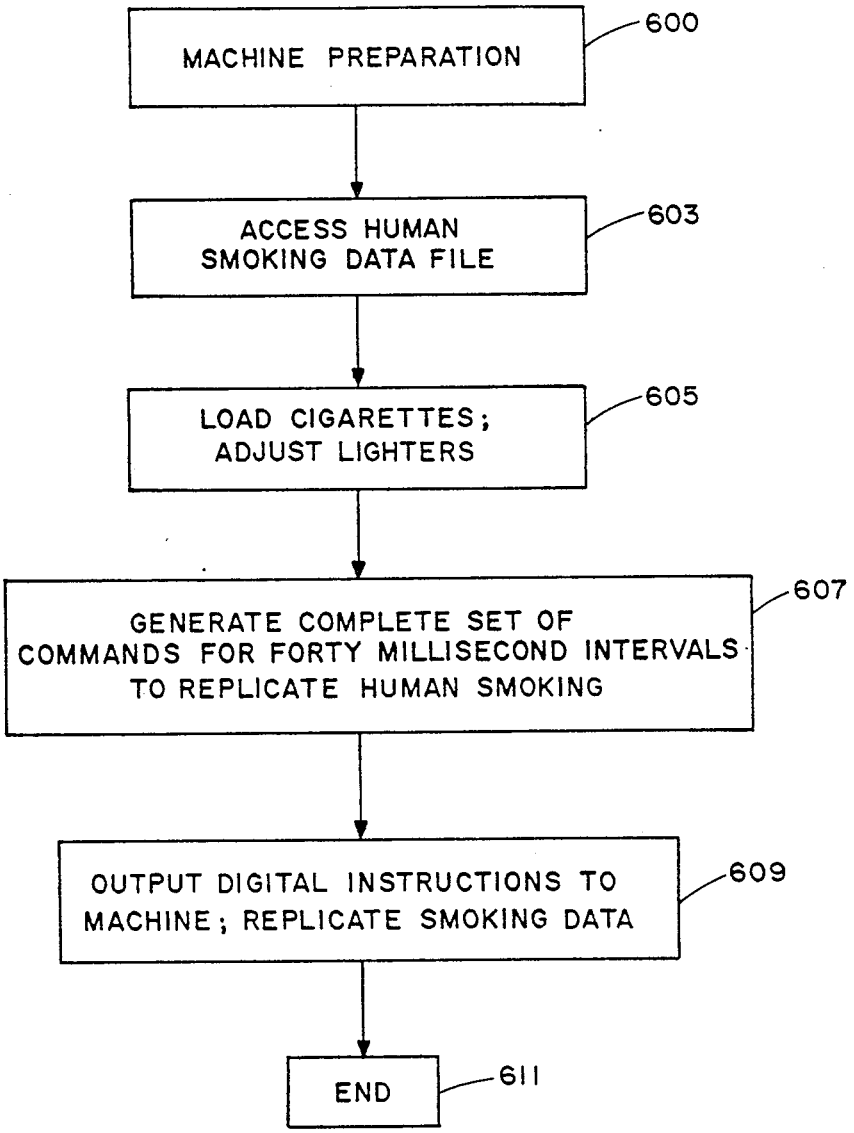
FIG. 6 sets forth an overview of a control method according to the invention.

FIG. 6 illustrates a general overview of a preferred system operation which is conducted using a microcomputer. With reference to FIG. 6, a first step involves machine preparation, discussed in further detail later. A human data smoking file has been loaded into data storage means and is accessed in step 603. In step 605 the program indicates to the operator via CRT screen 24 (FIG. 1) that cigarettes are to be loaded and lighters adjusted. These steps can be performed automatically. In the apparatus shown in FIGS. 1–5, the cigarettes are loaded and the lighters adjusted manually. An operator loads individual smoking articles into the holders shown in FIGS. 4 and 4A, discussed previously. Lighters which are in the contact configuration shown in FIG. 2 are moved upon support 79 until the lighting coil of the lighter touches the lighting end of each smoking article.

At this point, the control system will read the complete data file of the recorded draw profile, one datum point at a time, and will generate a complete set of machine operation commands, each comprising a 16 bit array, for each 40 millisecond interval of the recorded draw profile, as indicated in step 607. As indicated previously, a human draw profile consists of a sequence of pressure differential readings taken periodically, in this case, every 40 milliseconds. Prior to use in the control system discussed herein, the draw profile data are preferably converted into linear distances (centimeters) defining the instantaneous position of the piston within the smoking machines vacuum cylinder. Such conversion is discussed in greater detail hereinafter. It will be apparent to those skilled in the art that the data can be provided to computer 23 in the form of 40 millisecond pressure differential readings and the conversion to piston positions carried out as a part of the control method of FIGS. 6–10. It will also be apparent that a complete set of commands may be input at this point where the commands have been previously determined.

The human draw profile data which is input into the system consists of puff phases and smolder phases which are located between the puff phases. During the smolder phases, the recorded pressure differential will be zero. In the preferred method discussed herein, puff profile data file will consist of pressure differential readings for each 40 milliseconds of a puff phase while the smolder phase is indicated by both a zero character and time characters which, in turn, represent the duration of smolder phase.

The commands generated in step 607 for each 40 millisecond datum point are advantageously 16 bit arrays. The first 12 bits of the 16 bit array are used for defining the position of the piston in the vacuum cylinder. Thus, the position can be any one of 4,096 positions ($2^{12}$ positions). Of the remaining 4 bits, one bit is used for puff valve 49 and defines either an inhale or exhaust state. One bit is used for the valve controlling the lips and defines an opened or closed state. One bit is used for the valve controlling pneumatic supply to the automatic lighter and defines either a contact or retracted state. The final bit is used for electric supply to the lighter and defines either an on or off state.

Following generation of the complete set of machine instructions in the form of 16-bit arrays, the arrays are fed to interface 25, one at a time every 40 milliseconds, until the recorded draw profile has been replicated. This is indicated in step 609. Thereafter, the control sequence is ended as indicated in bock 611.

Figure 7:
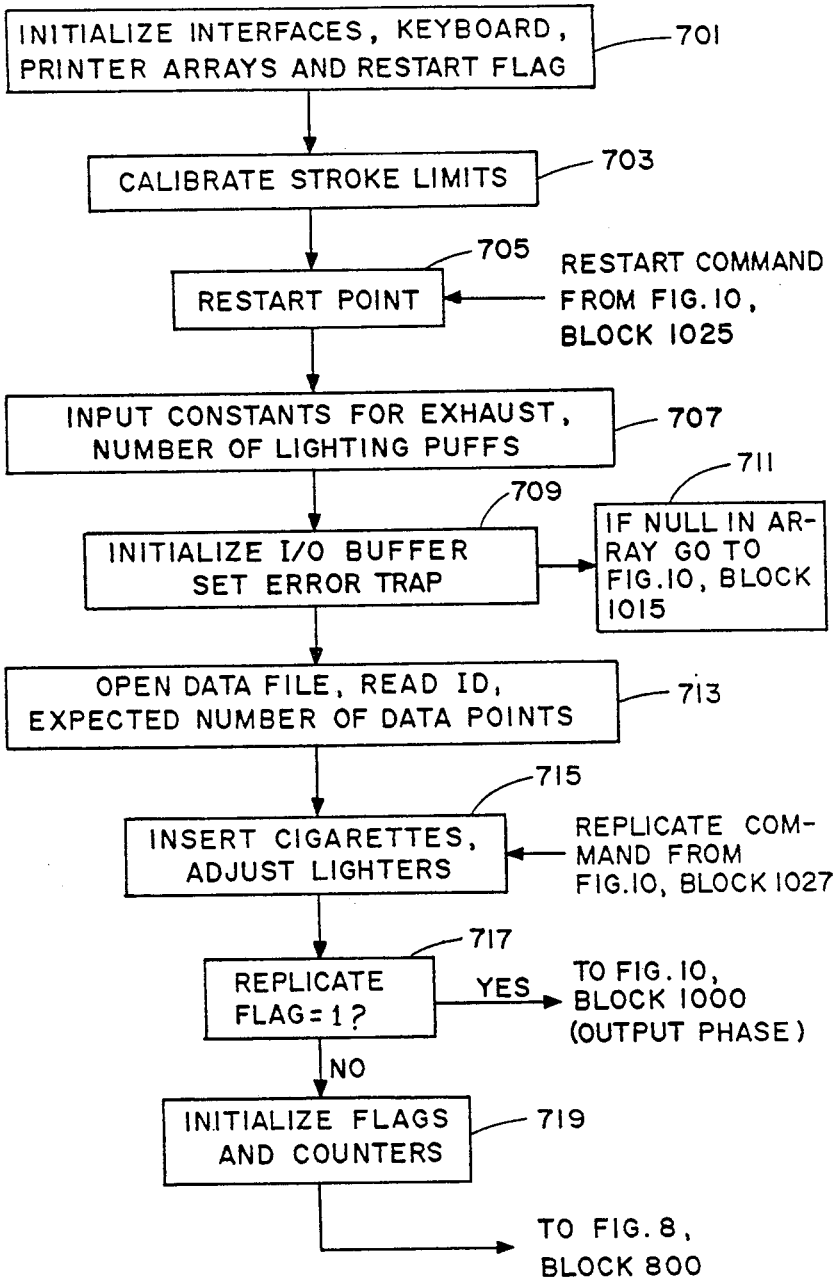
FIGS. 7–10 set forth in detail a preferred control method for operating a smoking machine according to the invention.

FIG. 7 illustrates in greater detail the initiation phase of that control sequence. The first step of the control sequence, step 701, involves initialization of all interfaces, the keyboard, printer, arrays and the restart flag. In step 703, a signal is sent to the human operator via CRT instructing the operator to calibrate stroke limits. The objective of this step is to calibrate voltage readings from potentiometer 141 with each of the 4,096 positions of piston 139 in hydraulic ram 29 and the calibration thereof to linear distance readings. Specifically, in step 703, lower plate 137 (FIG. 5) is first set by the computer at its uppermost location. The distance between upper plate 133 and lower plate 137 is determined automatically or manually and recorded. Thereupon, lower plate 137 is automatically moved to its lowermost position and the distance between upper plate 133 and lower plate 137 is measured and recorded. The computer then calculates the distance between the upper and lower stroke limits and determines the physical increment in centimeters for the 4,096 possible positions of the piston. This is then automatically correlated with readings from potentiometer 141 to determine the correspondence between millivolts and distance. It will be recognized that since lower plate 137 is connected via piston rod 135 to the piston within vacuum cylinders, the correlation between volume changes within the vacuum cylinder 55 and linear position changes of lower plate 137 can now be correlated precisely.

Step 705 is the restart point. As discussed in greater detail with reference to FIG. 10, at the end of the control sequence, new data can be input into the system for mimic of a new puff profile. When the system is restarted in this manner, steps 701 and 703 are bypassed and the system starts at step 705.

In step 707, the operator is instructed to input constants for exhausts, puff decay and the desired number of lighting puffs. The exhaust constant represents the minimal time which is required by the system to exhaust a tobacco puff. This is determined experimentally and normally ranges from about 120 to about 520 milliseconds. The constant for puff decay represents the amount of time following movement of the piston within the vacuum cylinder for the system to reach a state of quiescence. In other words, as smoke is puled through a cigarette and into the vacuum cylinder, a certain amount of time, normally between about 40 and about 120 milliseconds (depending on the system setup), is required for the smoke to reach a state of quiescence following passage of the smoke through the cigarette and into the system. This time period is referred to herein as puff decay. Both exhaust and puff decay constants can be input automatically.

Also in step 707, the operator has the option to input the number of lighting puffs. During the lighting of a cigarette, at least the first and sometimes more puffs are lighting puffs wherein the cigarette is being lit. If this is observed manually, the number of lighting puffs can be input at step 707. Otherwise, the control system will automatically determine the number of lighting puffs as discussed later with regard to FIG. 9.

In step 709, the system automatically initializes the input/output buffer and sets the error trap per step 711. The error trap set in step 711 instructs the system to proceed to step 1015 (FIG. 10) when a null character is detected in an array.

The system then proceeds to step 713 wherein the data file of a recorded draw profile is first opened. Thereupon, identification information is read from the file and the expected number of data points is determined. A data point counter is automatically set in the system so that the system will be able to properly identify the last datum, or end of data.

In step 715, the operator is instructed via the CRT to insert cigarettes and adjust lighters. At this point, the smoking machine apparatus automatically adjusts the lips to their opened position so that cigarettes can be inserted and will adjust the lighters to their contact position so that they may be slidably adjusted upon support 79 (FIG. 3) until the lighter element is in contact with the end of smoking article 41 (FIG. 3). Step 715 is also the initiation point for a replicate command which is discussed with reference to FIG. 10.

Figure 10:
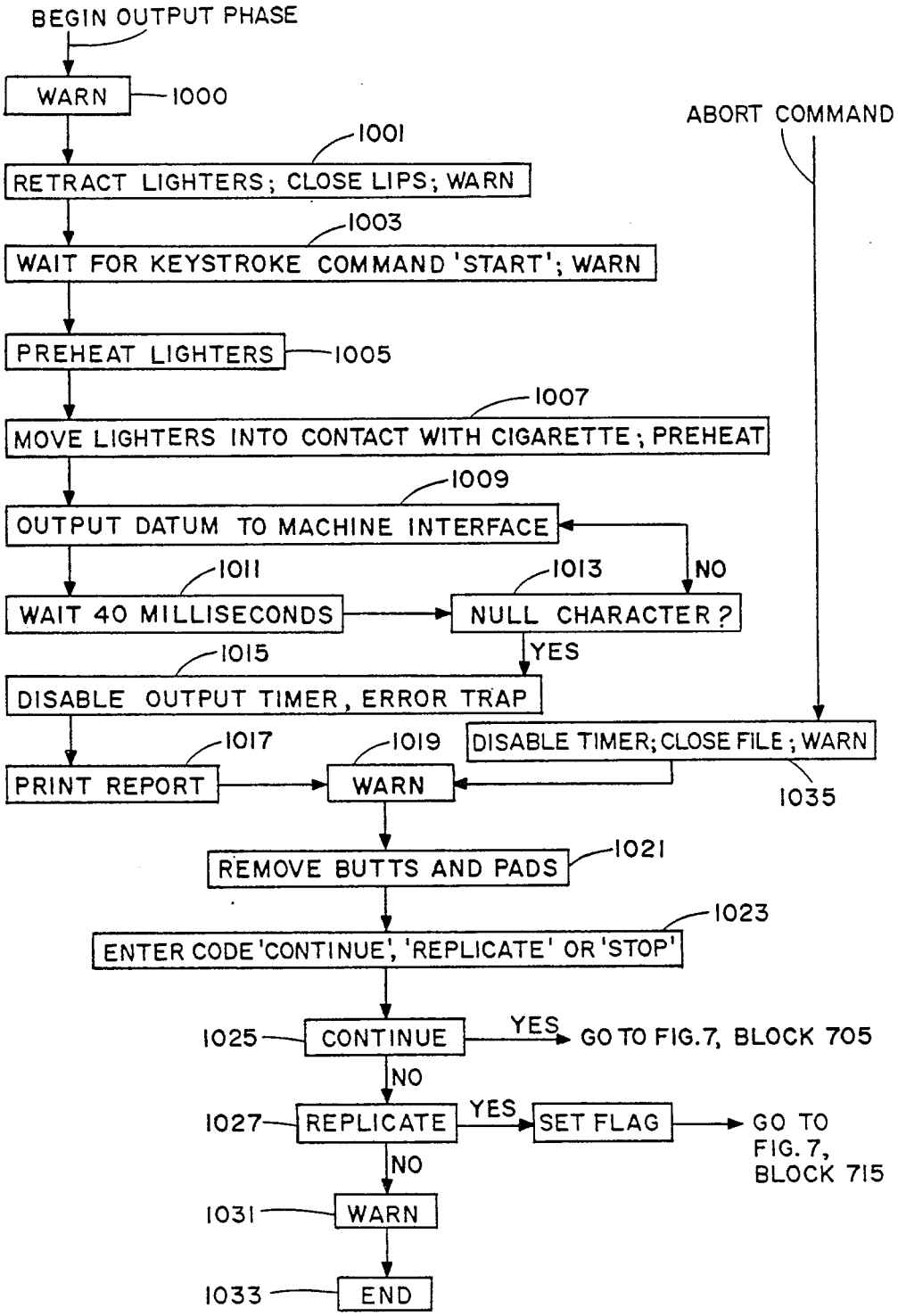

In step 717, the system examines the replicate flag and proceeds to the output phase of the program, FIG. 10, block 1000, if the replicate flag is set to one. Assuming that there is no replicate command and thus the replicate flag equals zero, the system proceeds on to step 719 wherein flags and counters are initialized to zero. The system preferably contains the following flags and counters:

- a flag to indicate whether or not all data have been read;
- a flag to indicate whether or not a given puff has been been exhausted;
- a flag to indicate whether or not the puff immediately prior to a given puff has been exhausted;
- a counter to determine the number of data points read;
- a counter to enumerate the command arrays stored within the computer memory;
- a counter to enumerate the beginning and/or end points of each puff contained within the data;
- a counter to enumerate the number of data points contained within all lighting puffs; and
- a counter to enumerate the number of puffs as each is processed.

The system then proceeds to step 800 wherein in this instance the first datum point of the recorded draw profile is read by the system. In step 801, the system determines whether the datum represents datum from a lighting puff. Assuming this datum is the first datum of the first puff and thus is a lighting puff, the system proceeds to step 803 wherein the lighting puff counter is automatically adjusted one point higher thus counting the number of lighting puff data. Thereupon, the system proceeds to step 805 wherein the total data counter is examined to determine whether this datum represents the last datum point. Since this is the first datum point, the answer is no and the system proceeds to step 807.

In step 807, the system examines the datum to determine whether it represents the beginning of the first puff or the end of any puff. As indicated previously, at the end of any puff, there is a smolder phase which is indicated by the character zero. Likewise, the first character of the first puff is also zero. Thus, if the datum being examined in step 807 is a zero, the answer will be yes. Assuming that this datum point is the first datum of the first puff, the datum is zero and the system proceeds to step 809.

In step 809, the exhaust flag is examined. This flag is automatically set from zero to one when the system does not exhaust (holds its breath) between puffs. Since the exhaust flag was set at zero in step 719, the system proceeds to step 811 wherein the datum is examined to determine whether it represents the beginning of a first puff. In this instance, it does and the system then proceeds to step 813.

In step 813, a complete array is generated for the single datum point. In this case, the array will be vacuum cylinder position zero, puff valve set to inhale state, lips in the closed state. The remaining two bits in the array are for the automatic lighter position and lighter heating element on or off. At this particular point, the array is always set to lighter retracted and element off. At a later point in the control program, step 937 (FIG. 9), the system will automatically adjust the two bits for lighter position and lighter element for each of the lighting puff arrays.

Following step 813, the system returns to step 800. In step 800, the system reads the second datum of the first lighting puff and proceeds to step 801. Since this is still a lighting puff, the counter is adjusted in step 803 and the system proceeds to step 805. This is not the end of the data and the system proceeds to step 807.

In step 807, it is determined that the datum is neither the beginning of the first puff nor the end of any puff and the program proceeds to block 815. The exhaust flag is set at zero so that the program proceeds to block 817. In block 817, the datum is examined to determine whether there is sufficient stroke remaining upon the piston of the vacuum cylinder to proceed to the location indicated in the datum. If not, the program proceeds to step 819 wherein an abort command sends the program to a later phase discussed in FIG. 10. Assuming there is sufficient stroke remaining, the program proceeds to step 813 wherein a complete array is generated as discussed previously (cylinder position, vacuum cylinder valve in inhale state, lips closed, lighter retracted, lighter off).

Blocks 821 and 823 are used when the exhaust flag is set at one. As discussed later with reference to FIG. 9, in those instances when there is not sufficient time to exhaust between puffs, the vacuum cylinder "holds its breath" and the exhaust flag is then set to one. In those instances, the portion of the array representing the position will have its basis adjusted as indicated in steps 821 and 823 to reflect that the starting point of the puff is not position zero.

Figure 8:
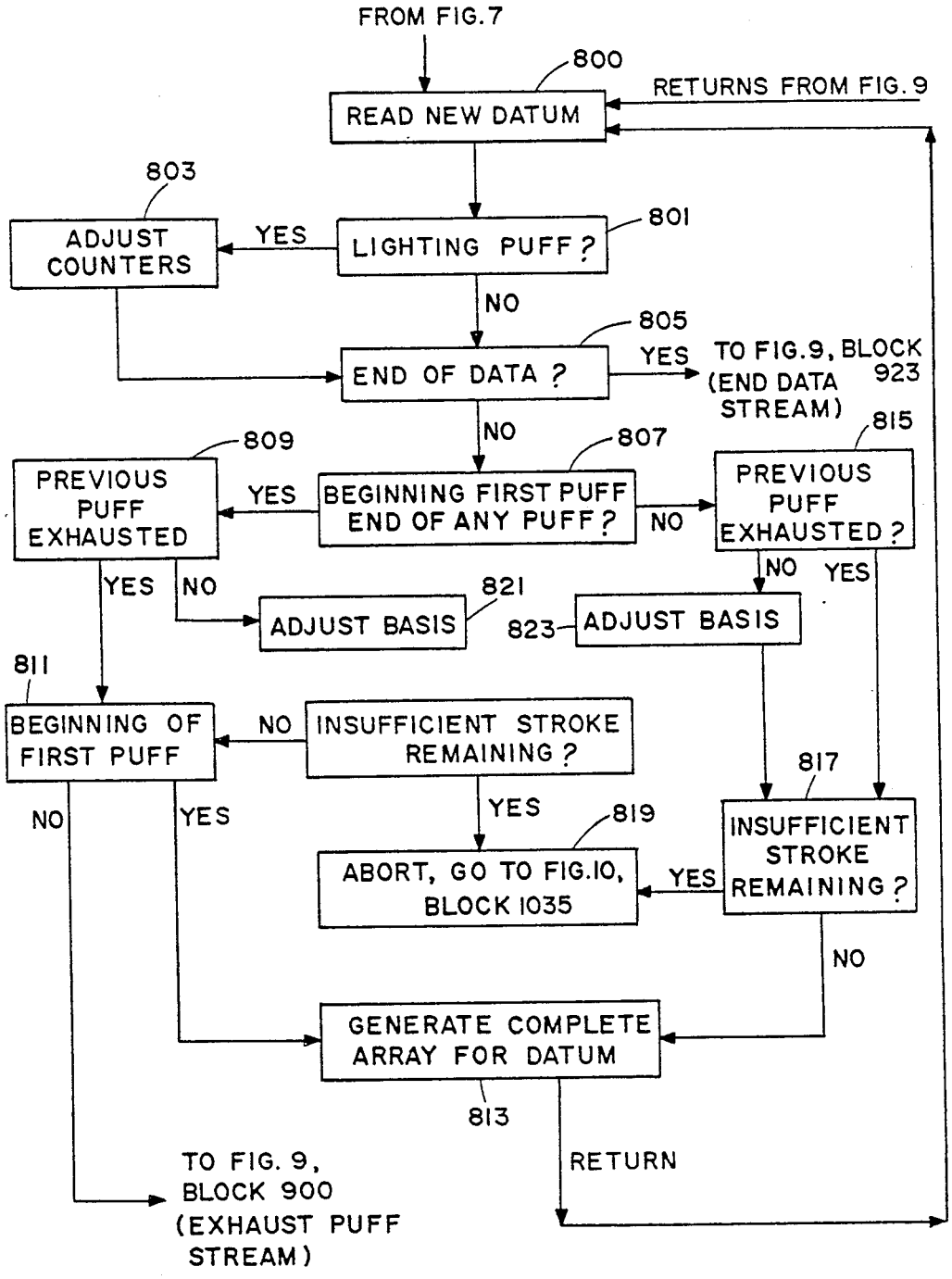

Still with reference to FIG. 8, data are continually read and arrays generated for each datum point of the first puff. When the datum point representing the end of the first puff is reached, i.e., when a zero is detected, the program proceeds from step 807 to step 809. Since the exhaust flag is still set at zero, the program proceeds to step 811 and from there to block 900, FIG. 9, since the datum does not represent the beginning of the first puff.

Figure 9:
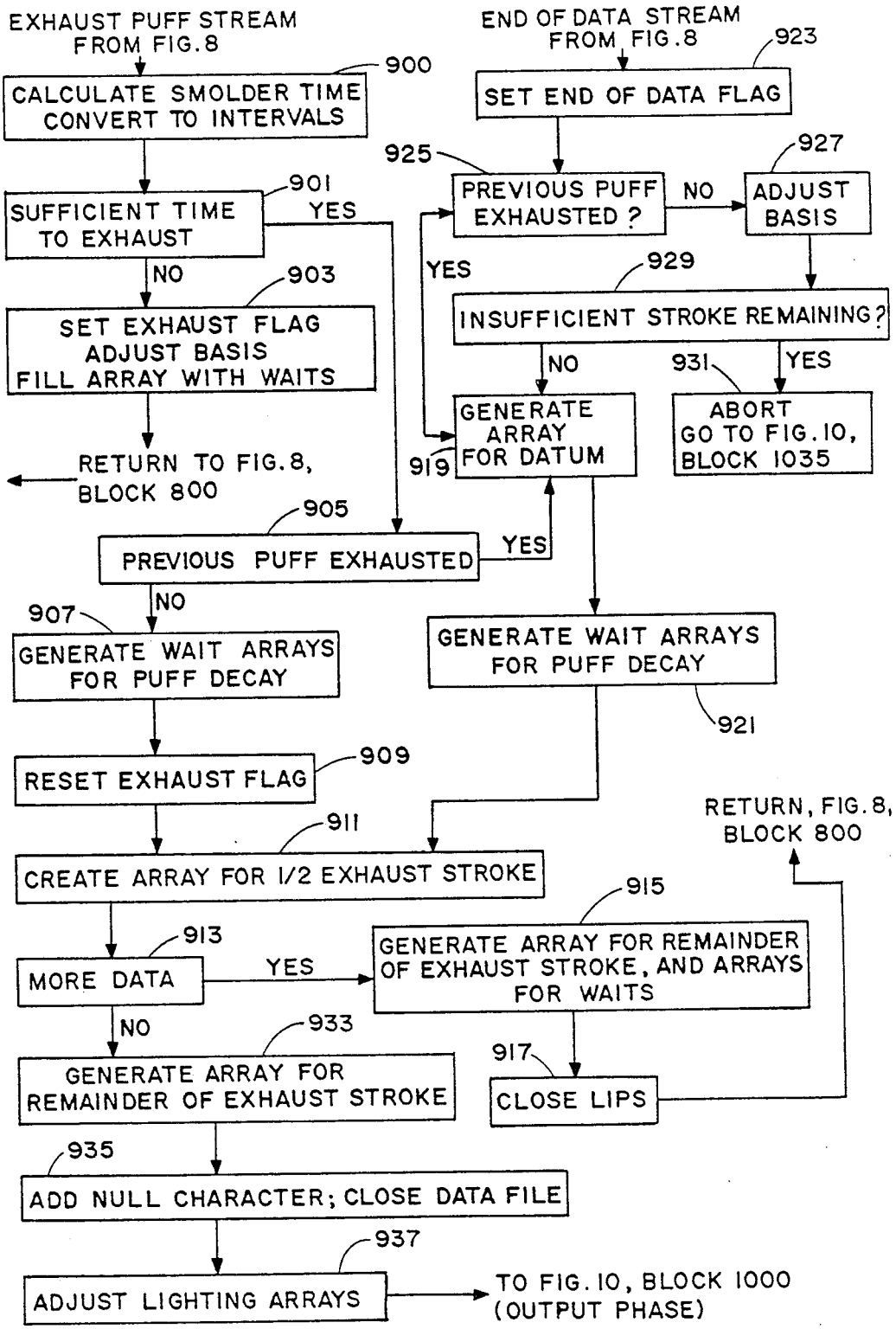

With reference to FIG. 9, the datum representing the end of the first puff will be a zero. The next four data are time data which indicate when the puff ended and when the next puff begins. In the steps represented by block 900, the smolder time is calculated and converted into 40 millisecond intervals. The program proceeds to step 901 wherein it determines whether there is sufficient time to conduct an exhaust cycle. An exhaust cycle consists of several parts. A first puff decay part, discussed previously, plus two 40 millisecond intervals for exhausting the vacuum cylinder in two steps; plus sufficient decay time to allow vacuum cylinder and valves to reach a state of quiescence following exhaust, i.e., exhaust decay. The time needed for exhaust (which is contained as a constant in memory storage) is compared in step 901 with the time calculated in step 900 to determine whether there is sufficient time for exhaust. Assuming there is not sufficient time for exhaust, the program then proceeds to step 903 wherein the exhaust flag is set to one, and the basis or position of the cylinder is recorded in memory. Additionally, in step 903 wait arrays are generated for the smolder cycle. Each wait array tells the vacuum cylinder piston to remain at the same location, however, two types of waits are generated. A first set of wait signals provide for the puff decay cycle. In these wait arrays, the lips remain closed and the vacuum cylinder valve remains in the inhale state. In this case (i.e., the puff will not be exhausted), the waits for the portion of the smolder cycle following the puff decay waits set the vacuum cylinder valve in the inhale configuration and sets the simulated lips in the closed configuration. The number of puff decay waits is determined by constants fed into the system earlier. The number of smolder waits is determined by the length of the smolder time in the recorded draw profile. Thereupon the program returns to FIG. 8 block 800 wherein a new datum representing a portion of a puff is read. The system then generates arrays for each datum point of this next puff in the previously discussed manner.

Upon reaching the last datum point of this puff, the program again returns to block 900 and to block 901. Assuming there is sufficient time to exhaust, the program proceeds to step 905 wherein the exhaust flag is examined. Assuming the exhaust flag is one, the program proceeds to step 907 wherein puff decay wait arrays are generated (same position as last position, vacuum cylinder valve in inhale state, lips closed.) The program then proceeds to step 909 wherein the exhaust flag is now reset to zero, and onto step 911. In step 911, a single array is generated for movement of the vacuum piston to a position one-half the distance to a full exhaust with puff valve in exhaust state and lips open. The program proceeds to step 913 and assuming there are more puffs in the stored draw profile, onto step 915. In step 915 an array is generated for the remainder of the exhaust stroke, and additionally exhaust decay waits are generated. The exhaust decay waits maintain the vacuum piston at its maximum up or closed position and maintain the vacuum cylinder valve in the exhaust state and the lips in the open state. The program proceeds to step 917 wherein another array is generated for the same position but with closed lips and vacuum cylinder valve in the inhale state.

The arrays for completion of the exhaust cycle having been completed, the program returns to block 800 and proceeds through the cycle shown in FIG. 8 until a complete set of arrays has been generated for the next puff cycle. Thereupon, the program reaches a datum representing a puff end and returns to block 900 and onto block 901. Assuming there is time for exhaust, the program proceeds to step 905. Since the exhaust flag is now set to zero, the program proceeds to step 919 wherein a single wait array is generated. The program then proceeds to step 921 wherein puff decay wait arrays are generated in the manner discussed earlier.

The program then proceeds, as discussed previously, through steps 911, 913, 915, 917 and back to block 800. The program then proceeds through the remaining puff and smolder cycles until it reaches the end of data at block 805 (FIG. 8).

When the last datum point is reached, the control system proceeds to step 923 (FIG. 9). In step 923, the end of data flag is set to a value of one, and the program proceeds to step 925. If the previous puff has not been exhausted, the basis position is adjusted in step 927 and the program proceeds to step 929. If insufficient stroke is remaining as determined in step 929, the program proceeds to the abort cycle indicated at block 931 and otherwise proceeds to step 919 and on to steps 921, 911 and 913 discussed previously. In step 913, the end of data flag is detected and the program proceeds to step 933 wherein an array for the remainder of the exhaust stroke is generated. The program then proceeds to step 935 wherein a null character is added as the final array. Thereupon, the program proceeds to step 937. In step 37, the lighting puff counter set in step 803 is examined. The number of lighting puff data is determined by reading the counter. The arrays corresponding to each of those lighting puff data, together with the intervening smolder cycles (if there is more than one lighting puff) are adjusted. To each of these arrays are added instructions for the automatic lighter position bit and the automatic lighter on/off bit. These bits are adjusted to be set at lighter position in contact position and lighter on.

In a preferred embodiment of the control system, step 937 includes a subroutine which automatically calculates the number of lighting puffs. This is accomplished by comparing the intervals between the first three puffs with an experimentally determined constant of 3000 milliseconds. If the inter-puff intervals are shorter than this time, the puffs are assumed to be lighting puffs and the arrays for lighter position and on/off are then adjusted. One, two or three (but no more than three) lighting puffs may thus automatically be selected.

The program then proceeds to the output phase discussed with reference to FIG. 10.

With reference to FIG. 10, the program proceeds to the output phase when a complete set of arrays for the recorded draw profile have been generated. In step 1000, a series of warning signals is activated indicating that the automatic smoking machine is about to be set in motion. The program proceeds to step 1001 wherein a signal is fed to interface 25 for retracting the lighters, closing simulated lips and again warning. The program proceeds to step 1003 wherein the system waits for the keystroke command "start" and again warns.

Upon input of the start command, the program proceeds to step 1005 wherein a signal is sent to interface 25 for preheating of the lighters. The lighters are preheated for a period of about ten seconds and the program proceeds to step 1007 wherein the lighters are moved into contact with the cigarettes and the end of the cigarette is preheated for a period of about one second. Following preheating of the cigarettes, the program proceeds to step 1009 wherein the first datum in the array is output to interface 25. The program proceeds to step 1011 wherein there is a wait of 40 milliseconds. If datum does not consist of the null character, the program returns to step 1009 and outputs the second array. This cycle continues for the entire set of arrays representing the recorded draw profile data until the null character is detected at 1013. An attempt to transfer the null character to the output buffer causes an error condition to arise, and, thereupon, the program proceeds to step 1015. It will be recognized that each array will now carry instructions for cylinder position, puff valve, automatic lips, lighter position and lighter element. Operation of puff valve, automatic lips, lighter position and lighter element has been discussed previously. Piston position is controlled by valve 37 (FIG. 1) which allows sufficient hydraulic fluid to move into or out of hydraulic ram 29 during the 40 millisecond period for the ram piston to move from its existing position to the position dictated by the array.

In step 1015, the 40 millisecond output timer is disabled and the error trap is likewise disabled. The program then proceeds to step 1017 wherein a report is generated. The report preferably contains the following data: the date and time of day, the data file name, the name (version) of the control program, the calibration factor, the program line number wherein the error condition arose, the error code number, the interface select code (identifies the I/O buffer), the expected and found number of puffs and additional information regarding the cigarette and flow measurement device used in the original puffing measurements.

The program then proceeds to step 1019 wherein a warning is issued, and on to step 1021 wherein the lips are opened and the program waits while cigarette butts and Cambridge filter pads are removed for analysis.

Thereupon, the keystroke command representing either continue, replicate, or stop is entered (step 1023) and the program continues to step 1025. If the continue stroke has been entered, the program returns to step 705 to begin a new recorded draw profile.

If continue has not been input in step 1023, the program continues to step 1027. If the command replicate was entered in step 1023, the program proceeds from step 1027 to step 1029 wherein the replicate flag is set to one and the program then returns to FIG. 7, block 715.

If the replicate command has not been entered, the program proceeds to step 1031 wherein a warning is issued that the system is about to turn off. In step 1033, the system is automatically shut down.

The abort cycle is also indicated in FIG. 10. As indicated previously, when the data analysis and array generation portion of the program determines that there is insufficient stroke remaining in the vacuum cylinder to proceed to the necessary position, an abort command is entered. In this case, the program proceeds to step 1035 wherein the timer is disabled, the file is closed, and a warning issued. Thereupon, the program proceeds to step 1019 and through the remaining steps, discussed above.

DATA ACQUISITION AND CONVERSION

As indicated previously, the data is collected by monitoring a desired draw profile, preferably of a human, and recording digitally, pressure differentials. Advantageously, pressure differentials are recorded every 40 milliseconds. If desirable, pressure differentials can be recorded every 20 milliseconds to more accurately determine the beginning of a puff. In the latter case, the datum representing the first puff datum and the remaining odd numbered data, i.e., data 1, 3, 5, 7 etc., are saved to generate the 40 millisecond draw profile. Even numbered data, i.e., data 2, 4, 6, 8 etc., can be discarded, thus providing data recorded every 40 milliseconds. The above recorded flow profiles represent 40 millisecond measurements of flow rate. These are readily converted to volume per 40 milliseconds, i.e., flow rate times 40 milliseconds equals volume of puff in the 40 millisecond interval. Volume can then be converted into linear distances inside the vacuum cylinder since the internal diameter of the vacuum cylinder is known precisely. The resultant data can be used in the smoking machine of the invention.

In a most advantageous embodiment of the invention, the data is corrected or massaged to minimize so-called dynamic error. As with any dynamic control system, there is an inherent machine distortion of the input signal which results in imperfectly reproduced puff profiles. For the apparatus of this invention, this error takes primarily the form of a time lag and subsequent amplitude reduction error in the response (output) signal. This dynamic error is due to the parts making up the apparatus. Specifically, the apparatus consists of many varied interacting components—electronics, pistons, pump, hoses, mechanical parts, etc. During operation, each component is subject to one or more disruptive, "dissipative forces". Pistons are slowed by friction; airflow in hoses is complicated by turbulence and dead volumes; electrical conductivity is hindered by heated circuits. All contribute to decreased efficiency of the machine's working parts. Moreover each movement of the piston is affected by the previous movement of the piston.

Such dynamic error can be minimized or eliminated by the application of mathematical control theory. As will be recognized by those skilled in the art, control theory may be applied using either "classical" (Laplace domain) or "modern" (time domain) methodology.

One preferred dynamic error correction system was developed based on the following.

Using standard techniques of classical control theory (manipulations in Laplace domain) a massage of the measured human puff profiles was carried out to compensate for response error in the automated smoking apparatus. The mathematical procedure followed consisted of three primary steps. Each is described below.

The first step consisted of determining the system transfer function. This was accomplished by measuring the response of the machine to input flow step functions of varying magnitude. To account for the great majority of human puff flow rates, a step function of magnitude 80 cc/sec was selected as the final standard. The resulting output flow curves were fit using standard nonlinear regression techniques (Statistical Library for HP9826 and HP9836 Computers, Hewlett Packard, 1982) to a time domain response function containing two exponential terms. (Two exponential terms were found to yield sufficient fitting accuracy.) The resulting transfer function (second order) was then computed as $$T(s)=N*[(As^2+Bs+C)/(s^2+Ds+E)]$$

where N, A, B, C, D and E are simple functions of the fitting parameters. In the final realization of the massage algorithm, the parameters (especially "N") were varied freely by trial and error to test system sensitivity and to achieve a final optimal set for human profile reproduction.

The second step of the procedure involved preliminary treatment of the human puff profile data to prepare it for control theoretic massage. This is accomplished in two stages. First, the original flow data is smoothed by a compound running-median/hanning routine (Velleman and Hoaglin) to remove excessive noise in the profile. Next, the smoothed profile is subjected to a Fourier series analysis (HP98821A BASIC Numerical Analysis Library For the HP9826 and HP9836 Computers) to provide a continuous, series representation of the discrete flow rate data. Approximating the profiles by accurate Fourier series makes possible an analytic solution to the fundamental equation relating input and output signals.

Finally, combining the transfer function and series representations of puff data in the central control theory equation, provided the solution (in the Laplace domain) for that signal which produces the given human profile. Expression of the data in Fourier series form then allowed analytic inversion from the Laplace to time domains. The final form of the desired machine input signal is $$i(t) = N * \sum_{n=0}^{\infty}\left\{\left[\frac{a_nC_1 - b_nC_2}{C_3}\right] * \cos(x_nt) + \left[\frac{a_nC_2 + b_nC_1}{C_3}\right] * \sin(x_nt) + [a_nl_3 + b_nm_3x_n] * e^{-r_1t} + [a_nl_4 + b_nm_4x_n] \times e^{-r_2t}\right\}$$

where $a_n$ and $b_n$ are Fourier series coefficients of the smoothed profile; $r_1$, $r_2$, $C_1$, $C_2$, $C_3$, $l_3$, $l_4$, $m_3$ and $m_4$ are simple functions of the transfer function parameters; and $x_n$ is related to the period of the Fourier expansion. At any given time interval, this equation may be used to estimate the proper input flow rate (converted to voltages) that the smoking machine should receive to achieve a given output profile.

The procedure outlined above makes use of several standard numerical software algorithms including smoothing, splines, regression and Fourier series analysis. While any reliable version of these routines should suffice, the inventors have employed with success the smoothing algorithims found in *Applications, Basics and Computing of Exploratory Data Analysis* (P. F. Velleman and D. C. Hoaglin, PWS Publishers, 1981); the cubic spline and Fourier series routines found in the *HP98821A BASIC Numerical Analysis Library for the HP* 9826 *and HP* 9836 *Computers* (Hewlett-Packard Company, 1982); and the nonlinear regression routine from the *Statistical Library for the HP* 9826 *and* 9836 *Computers* (Hewlett-Packard, 1982).

Those skilled in the art will recognize that other analyzing or correcting systems can be employed for eliminating or minimizing to the desired level the inherent dynamic error.

Figure 11:
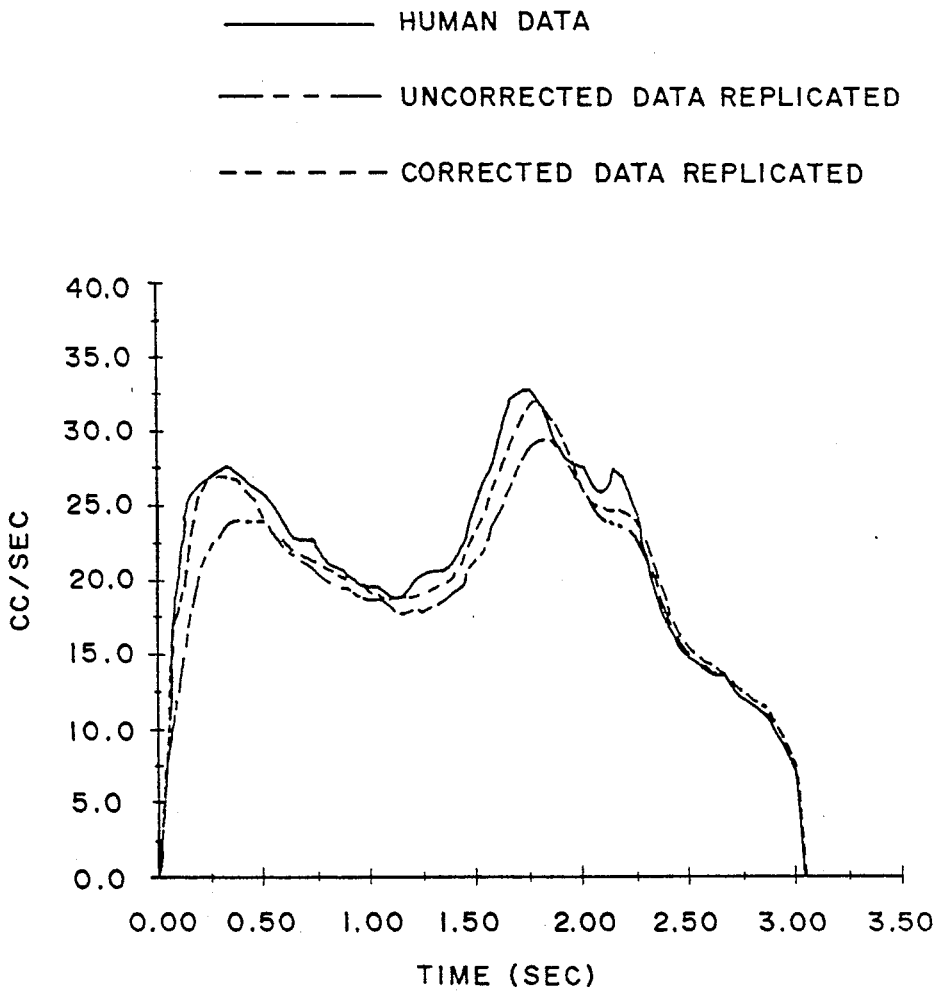
FIG. 11 depicts an "extreme" profile of a single puff as recorded from human smoking and replicated by the apparatus of FIG. 1 with and without correction of data.

In order to verify accuracy of the method and apparatus of the invention, a cigarette was smoked in a manner to provide "extreme" puff profiles which are known to be difficult to mimic by machine. During the smoking, the flow rate of puffs was monitored and recorded in the aforedescribed manner. Thereafter, cigarettes were smoked by a human mimic smoking apparatus substantially in the same form shown in FIG. 1. In one instance, the recorded data were fed to the automatic smoking apparatus in uncorrected form. In a second instance, the data were corrected according to the above-described procedure and then transmitted to the automatic smoking machine. In both instances, the instantaneous flow volumes of the cigarette being smoked by the automatic smoking machine were monitored and recorded by inserting the flow rate measuring device between the burning cigarette and the automatic lips of the automatic smoking machine. FIG. 11 graphically compares the single puff: (a) as smoked by a human; (b) when the recorded data are fed to the automatic smoking machine without prior correction; and (c) when the data are corrected according to the above described procedure before being fed to the automatic smoking machine. It can be seen that data correction substantially improves performance of the automatic smoking machine. When analyzed by a common least-squares error measure, the corrected data shown in FIG. 11 represents a 79% improvement over the non-corrected data when used for machine instructions. In a similar manner, other "extreme" puffs were generated and mimicked by the automatic smoking machine with and without data correction. Percent improvement of puff replication or mimicking ranged from 72% to 88%.

Those skilled in the art will recognize that other data correction techniques may be used to improve replication or mimic of recorded puff profiles by the automatic smoking machine of the invention.

The invention has been described in considerable detail with reference to preferred embodiments. However, variations and modifications can be effected within the spirit and scope of the invention as described in the foregoing specification and defined in the appended claims.

What is claimed is:

1. A multi-port automatic smoking machine comprising:

a plurality of suction means for simultaneously drawing smoke through a plurality of smoking articles; and actuation means for simultaneous operation of each of said suction means comprising a hydraulic ram operatively connected to each of said plurality of suction means.

2. The smoking means of claim 1 wherein said hydraulic ram is an hydraulic piston and cylinder means.

3. The smoking machine of claims 1 or 2 further comprising control means comprising:

means for generating control signals for controlling the operation of said actuation means for mimic of a predetermined draw profile including puff and smolder phases.

4. The smoking machine of claim 3 wherein said control means further comprises storage means for storing data representative of said predetermined draw profile.

5. The smoking machine of claim 4 wherein said control signals are digital control signals for positioning said hydraulic ram at predetermined locations representative of discrete intervals of said predetermined draw profile.

6. A smoking machine for smoking a smoking article according to a predetermined draw profile comprising in combination:

suction means for drawing smoke through a smoking article; control means for the suction means including, storage for storing data representative of a draw profile of a smoking article, said draw profile including puff and smolder phases; and means for producing digital control signals for discrete, periodic operation of said suction means to digitally mimic said predetermined draw profile including said puff and smolder phases.

7. The smoking machine of claim 6 wherein said digital control signals for providing discrete periodic operation of said suction means define the state of said suction means at periodic intervals of between about 20 and about 100 milliseconds.

8. The smoking machine of claim 6 or 7 wherein said inhaling means are piston and cylinder means and said smoking machine further comprising means responsive to said digital control signals for positioning said piston at a predetermined location within said cylinder as determined by each of said digital control signals.

9. The smoking machine of claim 8 wherein said means responsive to said digital control signals for positioning said piston comprise a hydraulically operated piston and cylinder means.

10. The smoking machine of claim 6 wherein said control means further comprises analyzing and correcting means for analyzing data corresponding to a measured draw profile of a smoking article and for correcting said data for dynamic error inherent in said smoking machine; and generating means for generating said data representative of said measured draw profile.

11. A smoking machine for smoking a smoking article according to a predetermined draw profile including puff and smolder phases which comprises in combination:

control means;

suction means responsive to said control means;

support means coupled to said suction means for supporting the smoking article, said support means including:

simulated flexible lip means having closed and open configurations, said closed configuration for grasping the mouthend of the smoking article in an airtight relationship, said open configuration for surrounding the mouthend of the smoking article in a non-airtight relationship;

said lip means being responsive to said control means for operation in a closed configuration during the puff phases of said predetermined draw profile and for operation in said open configuration during at least one smolder phase of said recorded draw profile.

12. The smoking machine of claim 11 further comprising automatic lighter means adapted for movement between a retracted position out of contact with said smoking article and a contact position in contact with said smoking article; said automatic lighter means being responsive to said control means for operation in said contact position during lighting puffs of said recorded draw profile and for operation in said retracted position during non-lighting puffs of said recorded draw profile.

13. The smoking machine of claim 12 wherein said lighter means further comprises a heating element and switch means responsive to said control means for supplying electricity to said heating element while said automatic lighter is in said contact position.

14. A system for operating a smoking machine comprising:

storage means for storing data representative of a measured draw profile of a smoking article including puff and smolder phases;

means for generating suction signals corresponding to said puff phases;

means coupled to said storage means for generating wait signals corresponding to a portion of said smolder phase;

means for determining whether the length of said smolder phase is greater than a predetermined amount;

and means responsive to said smolder phase length determining means for generating exhale signals when said smolder phases are greater than said predetermined amount.

15. The control system of claim 14 further comprising means for generating closed-to-atmosphere signals for said puff phases and open-to-atmosphere signals for a portion of said smolder phases; and means for generating wait signals for maintaining the smoking article in the closed to atmosphere configuration during a discrete time period after the end of each puff phase to allow for puff decay.

16. The control system of claim 15 further comprising abort signal generating means for terminating the smoking machine's operation, said abort signal generating means being responsive to an analyzing means for determining when the value of an inhale signal is greater than a predetermined value.

* * * * *